US010557446B2

(12) United States Patent
Stecklein et al.

(10) Patent No.: US 10,557,446 B2
(45) Date of Patent: Feb. 11, 2020

(54) LIQUID PUMP WITH CAVITATION MITIGATION

(71) Applicant: Caterpillar Inc., Peoria, IL (US)

(72) Inventors: Adam Stecklein, Peoria, IL (US); Joshua Carlson, Peoria, IL (US); Derik Warne, Bloomington, IL (US); Rajesh Paranjape, Dunlap, IL (US); Daniel Ibrahim, Germantown Hills, IL (US); Glenn Cox, Peoria, IL (US); Zhenyu Li, Peoria, IL (US); Ryan Hinrichsen, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 174 days.

(21) Appl. No.: 15/642,300

(22) Filed: Jul. 5, 2017

(65) Prior Publication Data

US 2018/0306150 A1 Oct. 25, 2018

Related U.S. Application Data

(60) Provisional application No. 62/488,975, filed on Apr. 24, 2017.

(51) Int. Cl.

| | |
|---|---|
| ***F02M 59/46*** | (2006.01) |
| ***F04B 11/00*** | (2006.01) |
| ***F04B 49/22*** | (2006.01) |
| ***F02M 59/34*** | (2006.01) |
| ***F02M 59/10*** | (2006.01) |
| ***F02M 59/02*** | (2006.01) |
| *F02M 59/16* | (2006.01) |

(52) U.S. Cl.

CPC ..... *F02M 59/464* (2013.01); *F02M 59/02* (2013.01); *F02M 59/022* (2013.01); *F02M 59/102* (2013.01); *F02M 59/34* (2013.01); *F04B 11/0091* (2013.01); *F04B 49/225* (2013.01); *F02M 59/16* (2013.01); *F02M 59/462* (2013.01); *F02M 2200/04* (2013.01)

(58) Field of Classification Search

CPC .. F02M 2200/04; F02M 59/08; F02M 59/464; F04B 11/005; F04B 11/0058; F04B 11/0066; F04B 11/0099

See application file for complete search history.

(56) References Cited

U.S. PATENT DOCUMENTS

| | | | | | |
|---|---|---|---|---|---|
| 3,759,637 | A * | 9/1973 | Vuaille | F02M 59/44 | 417/499 |
| 5,277,156 | A * | 1/1994 | Osuka | F02D 41/123 | 123/198 DB |
| 5,983,863 | A * | 11/1999 | Cavanagh | F02D 41/20 | 123/447 |
| 6,076,504 | A * | 6/2000 | Stavnheim | F02D 41/221 | 123/447 |
| 6,763,808 | B2 * | 7/2004 | Ryuzaki | F02M 59/08 | 123/446 |

(Continued)

*Primary Examiner* — Kevin R Steckbauer

(74) *Attorney, Agent, or Firm* — Jonathan F. Yates

(57) ABSTRACT

A liquid pump applicable in a fuel system such as a common rail fuel system includes a valve assembly having a valve stack with axially aligned components, dead volume, and vapor-distributing flow channels, for cavitation mitigation. An inlet valve meters a flow of liquid into the pump for pressurization by a plurality of reciprocating plungers operated by way of a rotating camshaft.

20 Claims, 4 Drawing Sheets

(56) References Cited

U.S. PATENT DOCUMENTS

| | | | | |
|---|---|---|---|---|
| 8,132,558 | B2 | 3/2012 | Lucas et al. | |
| 8,202,064 | B2 | 6/2012 | Tian et al. | |
| 9,464,631 | B2 * | 10/2016 | Shaull | F04B 53/10 |
| 9,512,836 | B2 * | 12/2016 | Shaull | F04B 53/10 |
| 10,107,244 | B2 * | 10/2018 | De Luca | F04B 1/04 |
| 2008/0003122 | A1 * | 1/2008 | Tian | F04B 11/0091 417/470 |
| 2008/0022973 | A1 * | 1/2008 | Puckett | F02D 41/123 123/446 |
| 2014/0193281 | A1 * | 7/2014 | Shaull | F04B 53/10 417/567 |
| 2014/0255219 | A1 * | 9/2014 | Lucas | F02M 59/366 417/282 |
| 2015/0275892 | A1 * | 10/2015 | Shaull | F04B 53/10 417/560 |
| 2017/0298887 | A1 * | 10/2017 | Peters | F02M 55/025 |

* cited by examiner

LIQUID PUMP WITH CAVITATION MITIGATION

TECHNICAL FIELD

The present disclosure relates generally to inlet metered liquid pumps with output control via an inlet throttle valve, and more particularly to an inlet metered liquid pump having a valve stack designed for cavitation mitigation.

BACKGROUND

In one class of high pressure liquid pumps, output from the pump is controlled by throttling the inlet with an electronically controlled metering valve. As a consequence, cavitation bubbles are generated when the output of the pump is controlled to be less than the volume displaced with each reciprocation of the pump plunger. One application for such a pump is in a fuel system that utilizes a common rail and a high-pressure fuel pump to pressurize the rail. In this specific example, the pump is driven directly by the engine, and the output from the pump is controlled by changing the inlet flow area via the inlet throttle valve.

When the inlet throttle valve reduces the flow area to the plunger cavity, cavitation bubbles can be generated in the vicinity of the throttle valve, or potentially elsewhere, and travel to the plunger cavity to occupy part of the volume created by the retracting plunger of the pump. When the cavitation bubbles collapse adjacent a surface, cavitation erosion can occur. In some instances, cavitation erosion can occur at undesirable locations, such as the inlet port passage or in the vicinity of valve seats. Depending upon where the cavitation damage occurs, and the extent of that damage, the pump performance can be undermined, and maybe more importantly, the eroded particles can find their way into fuel injectors possibly causing even more serious problems.

U.S. Pat. No. 8,202,064 B2 to Tian et al. is directed to an inlet throttle controlled liquid pump with cavitation damage avoidance feature. Tian et al. propose a specially shaped and sized cavitation flow adjuster extending from a valve member in a passive inlet check valve. A flow pattern is apparently formed by the valve in a way that encourages cavitation bubble collapse away from surfaces that could result in unacceptable cavitation damage to the pump. While Tian et al. appear to have provided advancements over the state of the art, additional developments relating to cavitation mitigation would be welcomed in the industry.

SUMMARY OF THE INVENTION

In one aspect, a valve assembly for a liquid pump includes a valve body having each of a fluid inlet and a fluid outlet formed therein. The valve body includes a valve stack forming an inlet valve seat and an outlet valve seat each positioned fluidly between the fluid inlet and the fluid outlet. An inlet check valve is positioned at least partially within the valve stack and movable between a closed position blocking the inlet valve seat, and an open position. An outlet check valve is positioned at least partially within the valve stack and movable between a closed position blocking the outlet valve seat, and an open position. A plunger is movable within the valve body between a retracted position and an advanced position. The inlet check valve, the outlet check valve, and the plunger define a common axis that extends through the valve stack, and the inlet check valve is located axially between the outlet check valve and the plunger. The valve body further has formed therein a pumping chamber receiving the plunger, an inlet chamber within the valve stack, and an outlet chamber within the valve stack. Each of the pumping chamber, the inlet chamber, and the outlet chamber are centered on the common axis. The valve assembly further includes a plurality of flow channels for transitioning a pumped liquid between the fluid inlet and the fluid outlet. The plurality of flow channels are arranged in a first parallel group extending between the inlet chamber and the pumping chamber and having a first circumferential distribution about the common axis, and a second parallel group extending between the inlet chamber and the outlet chamber and having a second circumferential distribution about the common axis.

In another aspect, a valve stack for a liquid pump includes an inlet piece having formed therein each of an inlet valve seat, a fluid inlet, and a plurality of incoming fluid passages extending between the fluid inlet and the inlet valve seat. The valve stack further includes an outlet piece positioned upon a first side of the inlet piece, the outlet piece having formed therein an outlet valve seat, and a fluid outlet. The valve stack further includes a pumping piece positioned upon a second side of the inlet piece such that the inlet piece is sandwiched between the pumping piece and the outlet piece, and an inlet check valve positioned at least partially within the inlet piece. The inlet check valve is movable between a closed position blocking the inlet valve seat, and an open position. The valve stack still further includes an outlet check valve positioned at least partially within the outlet piece, and movable between a closed position blocking the outlet valve seat, and an open position. The inlet piece, the outlet piece, and the pumping piece define a common axis. Each of the inlet check valve and the outlet check valve are movable along the common axis between the corresponding closed position and open position. The valve stack further forms an inlet chamber between the inlet piece and the pumping piece, an outlet chamber between the inlet piece and the outlet piece, a pumping chamber, and a plurality of flow channels. The plurality of flow channels are arranged in a first parallel group extending between the inlet chamber and the pumping chamber and having a first circumferential distribution about the common axis, and the second parallel group extending between the inlet chamber and the outlet chamber and having a second circumferential distribution about the common axis.

In still another aspect, a liquid pump includes a pump housing having each of a pump inlet and a pump outlet formed therein, and an inlet metering valve. A valve assembly is positioned within the pump housing and includes a valve body having a valve stack forming an inlet valve seat and an outlet valve seat. The liquid pump further includes an inlet check valve positioned at least partially within the valve stack and movable between a closed position blocking the inlet valve seat, and an open position. An outlet check valve is positioned at least partially within the valve stack and movable between a closed position blocking the outlet valve seat, and an open position. A plunger is movable within the valve body between a retracted position and an advanced position. The inlet check valve, the outlet check valve, and the plunger define a common axis that extends through the valve stack, and the inlet check valve is located axially between the outlet check valve and the plunger. The valve body further has formed therein a pumping chamber receiving the plunger, an inlet chamber within the valve stack, and an outlet chamber within the valve stack, and each of the pumping chamber, the inlet chamber, and the outlet chamber are centered on the common axis. The liquid pump further includes a plurality of flow channels for transitioning a pumped liquid through the valve stack and being arranged in a first parallel group extending between the inlet chamber and the pumping chamber and having a first circumferential distribution about the common axis, and a second parallel group extending between the inlet chamber and the outlet chamber and having a second circumferential distribution about the common axis.

DETAILED DESCRIPTION

Figure 1:
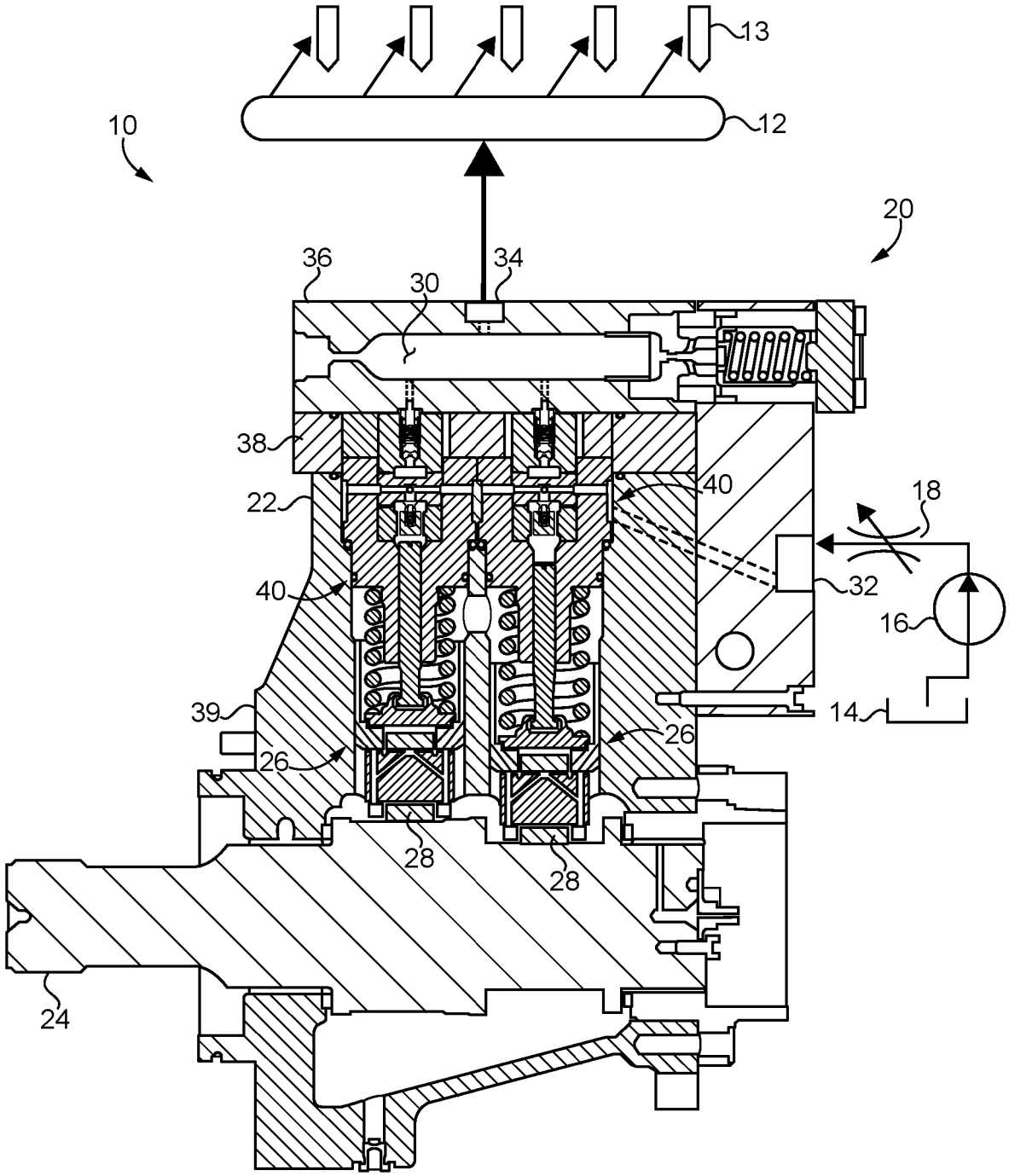
FIG. 1 is a sectioned side diagrammatic view of a liquid pump in a liquid system, according to one embodiment.

Referring to FIG. 1, there is shown a liquid system 10, such as a fuel system for an internal combustion engine. Liquid system 10 (hereinafter "system 10") may include a reservoir 12 for containing a pressurized fluid, such as a common rail or the like (hereinafter "common rail 12") that is structured to contain pressurized fluid and to feed pressurized fluid to a plurality of fluid delivery devices or fuel injectors 13. Liquid system 10 may include a fuel system structured for use in a direct injection compression ignition diesel engine, for example, where fuel injectors 13 are each positioned at least partially within an engine cylinder. Common rail 12 could include a single-bore, elongated pressure vessel, for example, or a plurality of separate fluid pressure accumulators coupled together in a so-called daisy chain arrangement, or still another configuration. System 10 also includes a liquid supply such as a fuel tank 14, and a low-pressure transfer pump 16 coupled with fuel tank 14, and structured to transfer fuel to a high-pressure liquid pump 20 by way of an inlet valve 18. Inlet valve 18 can include an inlet throttle valve that is adjustable to vary a flow area to liquid pump 20. Varying of the flow area meters a flow of fuel to pump 20 such that pump 20 pressurizes substantially only a quantity of fuel as is needed to maintain or achieve a desired fluid pressure in common rail 12.

Those skilled in the art will be familiar with the concept of an inlet metered pump as in the present context. Inlet valve 18 might be part of and within pump 20 or potentially positioned fluidly upstream of a pump housing 22 of pump 20. A suitable design for inlet valve 18 is known from commonly owned U.S. Pat. No. 8,202,064 B2 to Tian et al., discussed above, although the present disclosure is not thereby limited. Those skilled in the art will also be familiar with cavitation phenomena associated with inlet metered pumps. As will be further apparent from the following description, pump 20 may be structured according to multiple design concepts, which can be used together or independently of one another, to mitigate cavitation. The design concepts include, but are not limited to, robust and symmetric mechanical design, component positioning and arrangement, vapor distribution, reduced hydraulic stiffness, and biasing of the production and/or collapse of vapor bubbles towards areas within the liquid pump relatively less sensitive to cavitation damage.

Pump 20 includes a rotatable camshaft 24 positioned at least partially within pump housing 22 and structured to be rotated by way of an engine geartrain (not shown) in a generally conventional manner. Rotation of camshaft 24 causes the reciprocation of a plurality of pumping mechanisms 26 each equipped with a cam follower 28 for a plunger 78 in a generally conventional manner. Each of the plurality of pumping mechanisms 26 feeds pressurized fluid to a common fluid pressure space 30 (hereinafter "space 30") and thenceforth to common rail 12 by way of a pump outlet 34 formed in pump housing 22. A pump inlet 32 may be formed in pump housing 22 and is supplied with fuel at a flow determined according to a flow area of inlet valve 18 as described herein.

Figure 2:
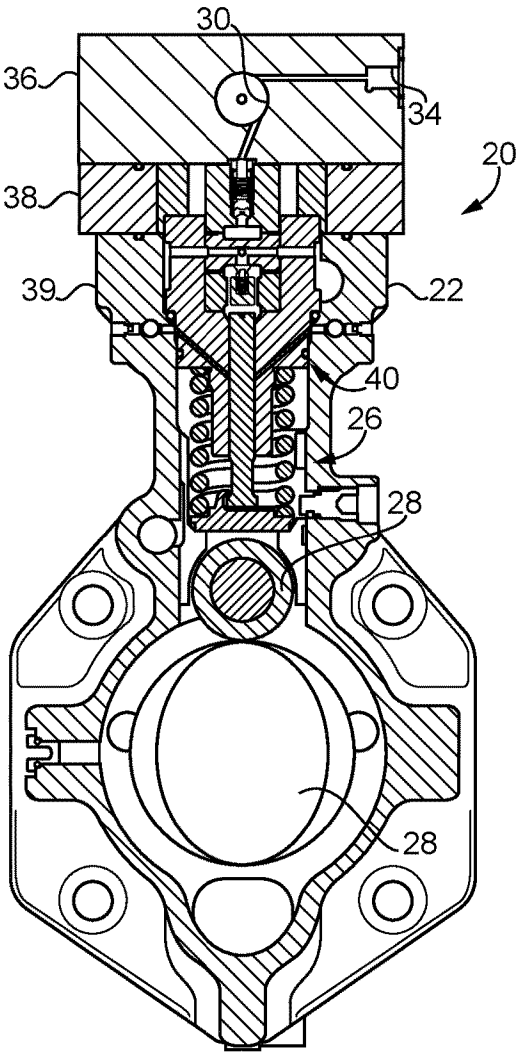
FIG. 2 is a sectioned end view through the liquid pump shown in FIG. 1.
Figure 4:
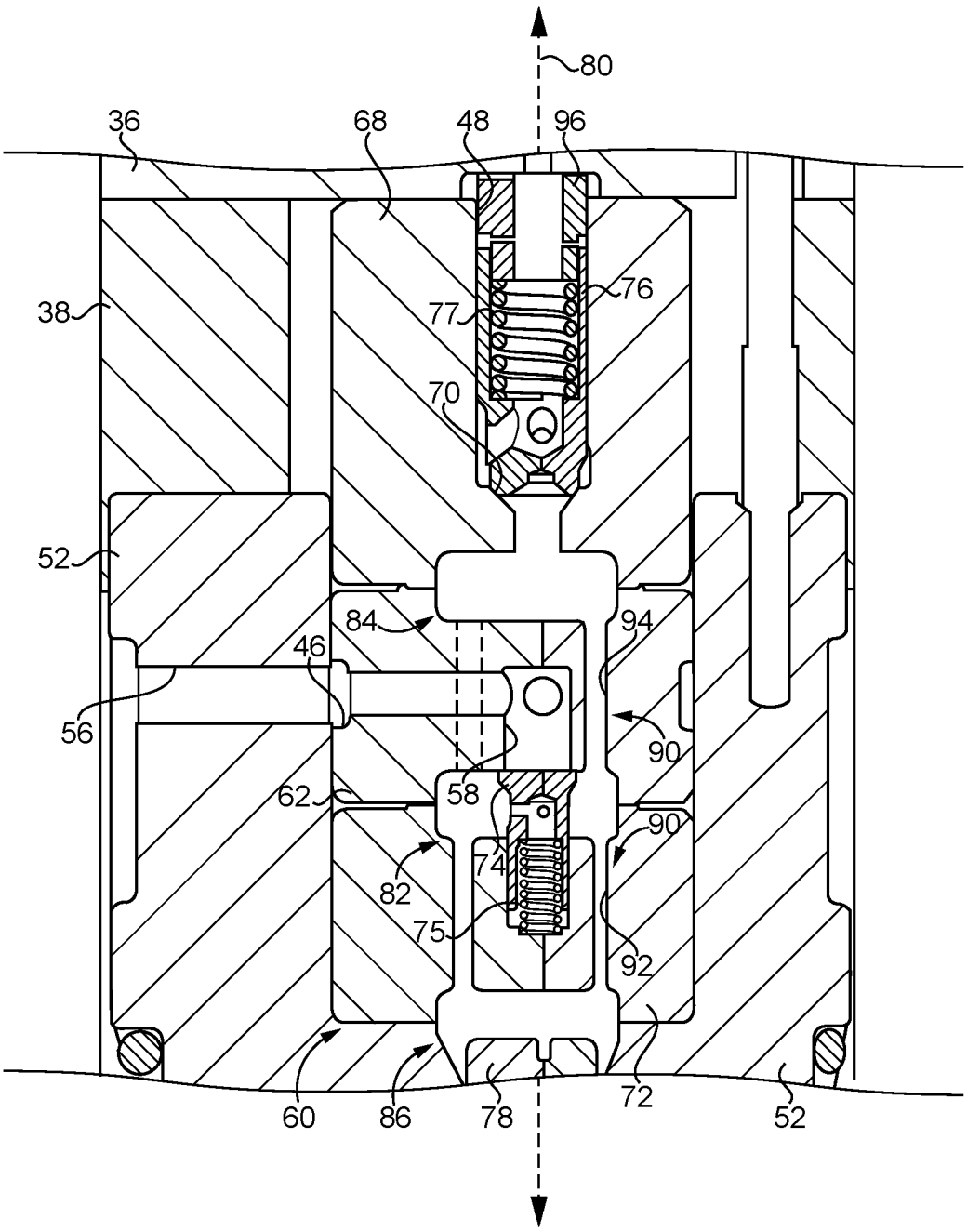
FIG. 4 is a sectioned view, in multiple section planes, through a portion of the liquid pump of FIGS. 1-3.
Figure 5:
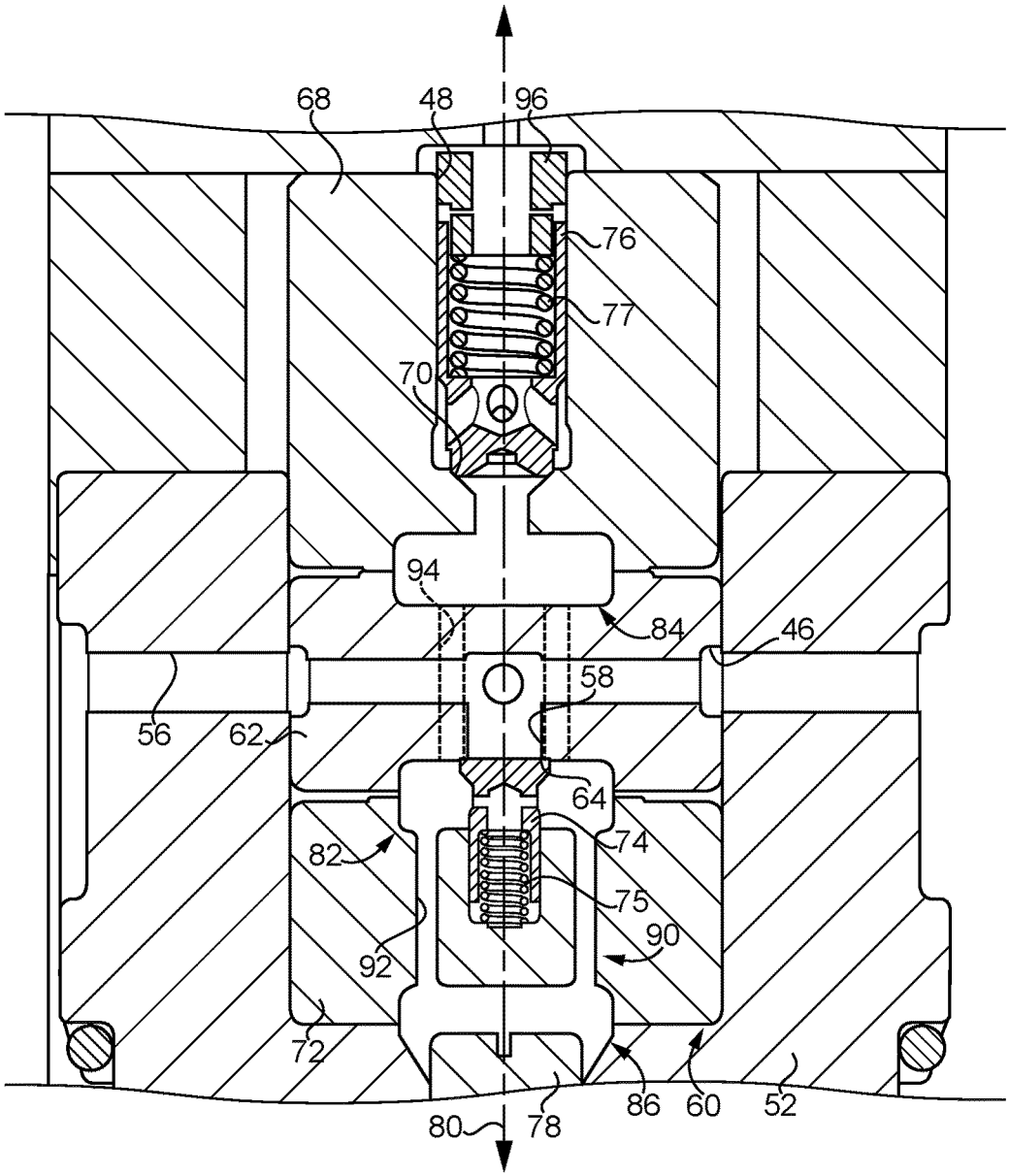
FIG. 5 is a sectioned view in one section plane, similar to FIG. 4.
Figure 6:
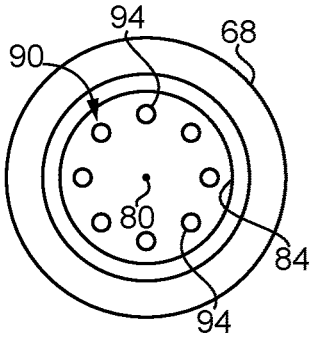
FIG. 6 is an axial end view of an inlet piece in a valve stack, according to one embodiment.
Figure 7:
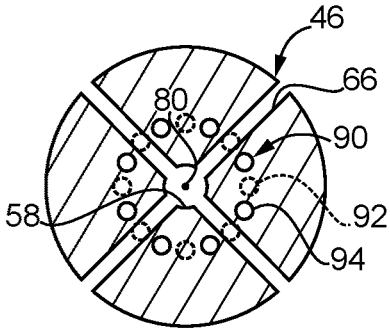
FIG. 7 is an axial section view through the inlet piece.

In the illustrated embodiment, pump housing 22 includes a plurality of housing pieces, namely, a first housing piece 36 defining space 30 and pump outlet 34, a second housing piece 38, and a third housing piece 39 wherein the plurality of pumping mechanisms 26 are disposed. It will be appreciated that a variety of different housing constructions including number and design of the various housing pieces, number of pumping mechanisms, and design and routing of the various plumbing features can vary from that which is illustrated. Moreover, additional valves such as a one-way valve between transfer pump 16 and inlet valve 18 and/or a one-way valve between pump outlet 34 and common rail 12 might be used, but are omitted from FIG. 1 for clarity of illustration. FIG. 2 illustrates an axial end view relative to camshaft 24, whereby it can be seen that rotation of camshaft 24 would cause the illustrated pumping mechanism 26 to reciprocate up and down, drawing liquid into pump 20 and filling space 30 for supplying the pressurized liquid to common rail 12. The total of two pumping mechanisms 26 in the illustrated embodiment would typically reciprocate out of phase, such as 180 degrees out of phase, with one another.

Figure 3:
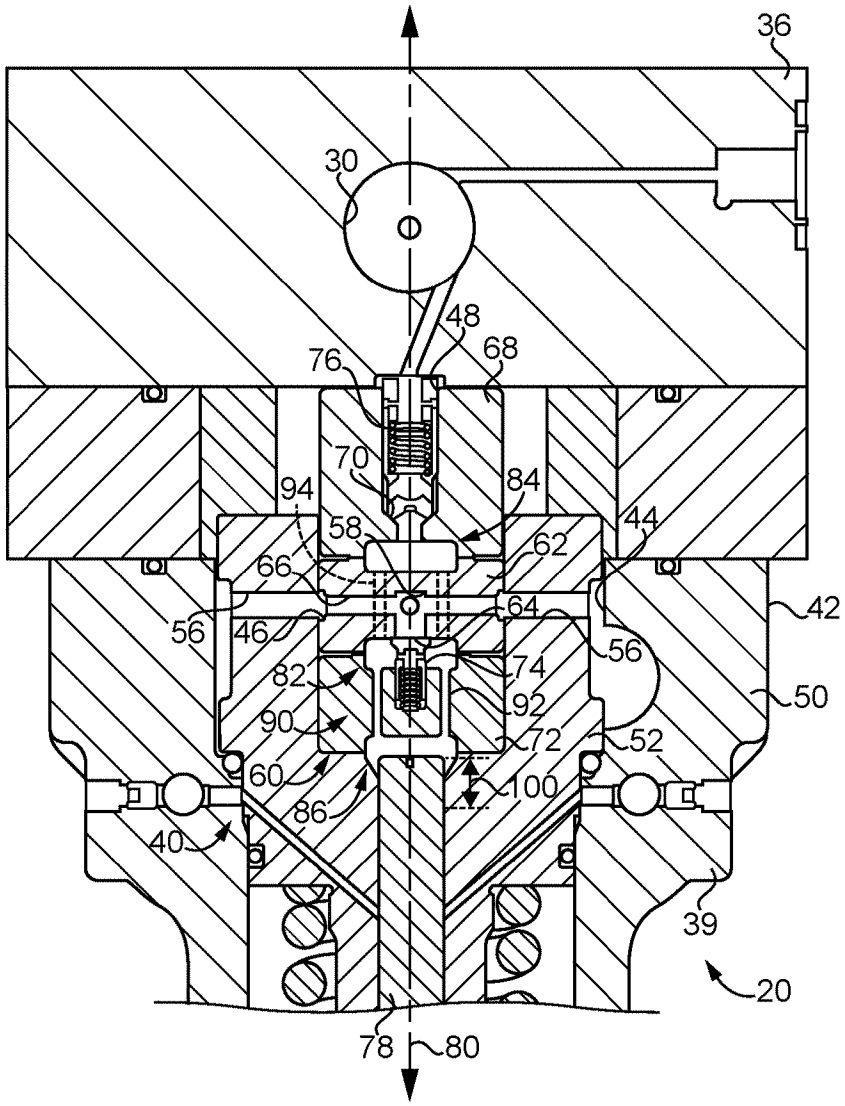
FIG. 3 is a sectioned side diagrammatic view through a portion of the liquid pump of FIGS. 1 and 2.

Pump 20 further includes a valve assembly 40 associated with each pumping mechanism 26. It should be appreciated that descriptions herein of any component or assembly in the singular, such as valve assembly 40 or pumping mechanism 26, is intended to refer analogously to any other of such components as are used in pump 20 or other embodiments contemplated herein. Valve assembly 40 includes a valve body 42 positioned within pump housing 22. Referring also to FIG. 3, valve body 42 has a fluid inlet 44 formed therein, in communication with another fluid inlet 46 formed by a valve stack 60 of valve body 42. Valve body 42 further includes a fluid outlet 48 also formed by valve stack 60. In the illustrated embodiment, valve stack 60 also includes an inlet piece 62 having formed therein each of an inlet valve seat 64, fluid inlet 46, and a plurality of incoming fluid passages 66 extending between fluid inlet 46 and inlet valve seat 64. Valve stack 60 also includes an outlet piece 68 positioned upon a first side of inlet piece 62. Outlet piece 68 has formed therein an outlet valve seat 70 and fluid outlet 48. A pumping piece 72 is positioned upon a second side of inlet piece 62, such that inlet piece 62 is sandwiched between pumping piece 72 and outlet piece 68.

An inlet check valve 74 coupled with a biasing spring 75 is positioned at least partially within valve stack 60 and at least partially within inlet piece 62. Inlet check valve 74 is movable against a biasing force of biasing spring 75 between a closed position blocking inlet valve seat 64, and an open position, not blocking inlet valve seat 64. An outlet check valve 76 associated with a biasing spring 77 is positioned at least partially within outlet piece 68, and movable between a closed position blocking outlet valve seat 70, and an open position not blocking outlet valve seat 70. A plunger 78 is movable within valve body 42 between a retracted position and an advanced position to draw liquid from pump inlet 32 into valve stack 60 by way of fluid inlet 46 and the various other fluid passages and connections of pump 20, and to pressurize the liquid and convey the same to space 30 to be conveyed to common rail 12 for injection into an engine cylinder.

It will be appreciated that with inlet valve 18 restricting inlet flow area to pump 20, the drawing in of liquid by way of retraction of plunger 78 will tend to cause the fluid pressure of the liquid to drop to or below a pressure at which vapor bubbles form in the liquid, which bubbles must be collapsed for pressurization to occur. The collapse of these bubbles can be associated with production of high velocity micro-jets of liquid which can impinge upon surfaces inside a pump to cause cavitation damage in the nature of erosion of material forming the surfaces. While cavitation phenomena will still occur during operation of pump 20, damaging cavitation phenomena is expected to be reduced in severity, and biased in terms of location to areas of the pump that are remote from surfaces sensitive to erosive damage, in accordance with the present disclosure.

Inlet piece 62, outlet piece 68, and pumping piece 72 define a common axis 80. Each of inlet check valve 74, outlet check valve 76, and plunger 78, is movable along common axis 80 between the corresponding closed position and open position, or in the case of plunger 78 retracted position and advanced position. It has been discovered that arranging substantially axisymmetric parts substantially coaxially as in valve stack 60 can have a number of beneficial effects, including improved symmetry and uniformity of flows of liquid, the ability to match stiffnesses of contacting parts so as to avoid relative motion and thus reduce or avoid fretting damage during service, and also relative uniformity of deformation of parts over time. For example the phenomenon known in the art as "seat beat-in" can be expected to occur in a relatively uniform pattern compare to alternative designs. It can further be noted that inlet piece 62 being axially sandwiched between outlet piece 68 and pumping piece 72 can position inlet check valve 74 axially between plunger 78 and outlet check valve 76. Arranging the valves as shown can, moreover, create a reduced amount of vapor at or near outlet check valve 76, particularly where inlet check valve 74 is arranged spatially and hydraulically in sequence with outlet check valve 76 in an axial direction away from plunger 78. In the illustrated embodiment, inlet valve seat 64 includes a flat seat, and outlet valve seat 70 includes a conical seat, each centered upon common axis 20. The relationships between the foregoing and other design features and cavitation phenomena are further discussed below.

It can further be noted that in the illustrated embodiment valve body 42 includes an outer valve body piece 50 and an insert piece 52 positioned within outer valve body piece 50. Insert piece 52 defines a central bore 54 and an annulus that forms fluid inlet 44, with piece 50. The terms "fluid inlet" and "inlet annulus" are used interchangeably herein. Insert piece 52 further includes a plurality of inlet orifices 56 formed therein that extend between fluid inlet or inlet annulus 44 and central bore 54. Inlet orifices 56 are generally radially extending and feed an axially extending inlet passage 58 in inlet piece 62. Valve stack 60 is within central bore 54 such that inlet annulus 44 is in fluid communication with inlet orifices 56 and with fluid inlet 46 in inlet piece 62. A plurality of incoming fluid passages 66 in inlet piece 62 extend radially inward from fluid inlet 46 to inlet passage 58.

As noted above, liquid pump 20, and in particular valve stack 60, is structured for reduced hydraulic stiffness, which can reduce the rate of pressure increase during a pumping or pressurization stroke with respect to time or "dp/dt", as further discussed below. To this end, valve stack 60 further forms an inlet chamber 82 between inlet piece 62 and pumping piece 72, an outlet chamber 84 between inlet piece 62 and outlet piece 68, and a pumping chamber 86 between pumping piece 72 and insert piece 52. As shown in FIG. 3, plunger 78 is movable a travel distance 100 that defines a swept volume. In an implementation, plunger 78 defines the swept volume, and inlet chamber 82, outlet chamber 84, and pumping chamber 86 along with a plurality of flow channels 90 to be described, define a combined volume greater than the swept volume. The combined volume may be from about two times to about three times the swept volume, and more particularly may be about 2.1 times the swept volume. Since dead volume can reduce pump efficiency by certain measures, a balance is struck at the described range between efficiency and smoothing out pressure rise to enable mitigating cavitation without unduly sacrificing efficiency, although the present disclosure is not thereby limited.

Valve stack 60 also forms a plurality of flow channels 90. Flow channels 90 may each be circular in shape and arranged in a first parallel group 92 extending between inlet chamber 82 and pumping chamber 86 and having a first circumferential distribution about common axis 80, and a second parallel group 94 extending between inlet chamber 82 and outlet chamber 86 and having a second circumferential distribution about common axis 80. A flow area formed by first parallel group 92 may be less than a flow area formed by inlet check valve seat 64. In an implementation, the flow area may be less by a factor of about 50%. It has been observed that providing the greater downstream flow area during filling can bias the production of vapor bubbles towards pumping chamber 82 instead of towards the valve seats or other regions, such that the collapse of vapor bubbles is less troublesome or more manageable.

Referring also now to FIGS. 4, 5, 6 and 7, in an implementation a total number of flow channels 90 in first parallel group 92 is equal to a total number of flow channels 90 in second parallel group 94. It can be seen that each of flow channels 90 in first parallel group 92 and second parallel group 94 has a uniform size, shape, and regular distribution. Each of flow channels 90 is also positioned at a uniform radial distance from common axis 80. Flow channels 90 in group 92 and group 94 may also be within a spatial envelope defined by inlet chamber 82, outlet chamber 84, and pumping chamber 86. Flow channels 90 in first group 92 may have an alternating arrangement about common axis 20 with flow channels 90 of group 94. A total number of flow channels 90 in each of group 92 and group 94 may be eight.

INDUSTRIAL APPLICABILITY

Those skilled in the art will appreciate that all inlet metered pumps will by definition have some vapor generation, and the vapor must be collapsed to enable pressure to rise and pumping of liquid to start. In general terms, to obtain minimal or zero erosion in an inlet metered pump the bubbles must be collapsed at a low enough energy level that the bubble collapse does not produce jets high enough in energy to damage surfaces. Bubble collapse energies tend to be high when bubbles are collapsed in regions of high ambient pressure. Pressure rise from below vapor pressure to significantly above vapor pressure that occurs relatively rapidly can result in bubbles being caught in regions of high ambient pressure. As a result, when these vapor bubbles are collapsed they can be problematic and produce cavitation damage. Relatively rapid pumping rates and relatively large plungers can be associated with a relatively large dp/dt at least at the start of pumping.

As discussed above, dead volume can result in less system stiffness due to fluid bulk modulus that drives down dp/dt. In addition, the even and uniform distribution, identical shape and identical size of flow channels 90 results in fluid pumping through flow channels 90 with minimal production of recirculation zones, eddies, or other uneven or non-laminar flows that can be associated with cavitation. The total number of flow channels being eight, the circular shapes, as well as uniform radial spacing from common axis 80 and uniform circumferential distributions about common axis 80 are believed to impart a tendency for the liquid to behave more as a bulk that moves relatively uniformly during pumping action of pump 20. Moreover, the distributed, uniformly sized and uniformly arranged and uniformly shaped flow channels can uniformly distribute vapor such that no one local region is subject to a particular damage of bubble collapse. The smaller flow area of flow channels 90 relative to the open inlet valve seat 64 can also assist in biasing the location of vapor production and/or collapse toward pumping chamber 86, and thereby avoid collapse at critical valve seats or structural hot spots. These and other approaches described herein can maximize life potential of the pump even if some background level of erosion is unavoidable.

Also, as discussed above, the axial stacking, of substantially axisymmetric parts, allows stiffnesses to be matched, thereby minimizing relative motion of mating components at sealing surfaces and reducing or eliminating fretting wear. Symmetrical, on-center valves tend to deform uniformly in the high pressure and highly cyclic environment of pump 20, around a 360 degree seat, ensuring consistent sealing even after minor breaking in or debris-related wear. It has been observed that ensuring consistent sealing, particularly at outlet valves or delivery valves such as outlet check valve number 76, assists in limiting erosion. Valve seat leakage between pumping events can generate high velocity flows at high cavitation numbers, with the vapor bubbles resulting from such flows collapsed at the start of the next pumping event and causing erosive damage in the vicinity of the leaking seat.

Locating inlet check valve 74 axially between the top of pumping chamber 86 and outlet check valve member 76 provides flow paths further mitigating cavitation. In certain earlier designs, vapor bubbles that do form can be chased to the most remote locations from the prime mover, commonly the delivery valve. Without a design provision to mitigate this phenomenon as set forth herein, vapor bubble collapse can occur at that location. It will also be recalled that inlet valve seat 64 can include a flat seat, minimizing flow area versus lift for a given size of valve. Such a design can cause or enhance restriction downstream of the subject valve seat, and does not rely on a knife edge to seal, making the design more resilient to debris damage.

The present description is for illustrative purposes only, and should not be construed to narrow the breadth of the present disclosure in any way. Thus, those skilled in the art will appreciate that various modifications might be made to the presently disclosed embodiments without departing from the fill and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A valve assembly for a liquid pump comprising:

a valve body having each of a fluid inlet and a fluid outlet formed therein, and including a valve stack forming an inlet valve seat and an outlet valve seat each positioned fluidly between the fluid inlet and the fluid outlet;

an inlet check valve, separate from the valve body, positioned at least partially within the valve stack and movable relative to the valve stack between a closed position blocking the inlet valve seat, and an open position;

an outlet check valve positioned at least partially within the valve stack and movable between a closed position blocking the outlet valve seat, and an open position;

a plunger movable within the valve body between a retracted position and an advanced position;

the inlet check valve, the outlet check valve, and the plunger defining a common axis that extends through the valve stack, and the inlet check valve being located axially between the outlet check valve and the plunger;

the valve body further having formed therein a pumping chamber receiving the plunger, an inlet chamber within the valve stack, and an outlet chamber within the valve stack, and each of the pumping chamber, the inlet chamber, and the outlet chamber being centered on the common axis; and a plurality of flow channels formed in the valve body for transitioning a pumped liquid between the fluid inlet and the fluid outlet, and being arranged in a first parallel group, defined by the valve stack, fluidly connecting the inlet chamber to the pumping chamber and having a first circumferential distribution about the common axis, and a second parallel group, defined by the valve stack, fluidly connecting the inlet chamber to the outlet chamber and having a second circumferential distribution about the common axis.

2. The valve assembly of claim 1 wherein a total number of the flow channels in the first parallel group is equal to a total number of the flow channels in the second parallel group, and wherein the first circumferential distribution is different from the second circumferential distribution such that the first parallel group and the second parallel group have an alternating arrangement about the common axis.

3. The valve assembly of claim 2 wherein a flow area formed by the first parallel group is less than a flow area formed by the inlet valve seat.

4. The valve assembly of claim 3 wherein the plunger defines a swept volume, and the inlet chamber, the outlet chamber, the pumping chamber, and the plurality of flow channels define a combined volume greater than the swept volume.

5. The valve assembly of claim 4 wherein the combined volume is from 2 times to 3 times the swept volume.

6. The valve assembly of claim 5 wherein the combined volume is 2.1 times the swept volume.

7. The valve assembly of claim 2 wherein the total number of flow channels of each of the first parallel group and the second parallel group is eight, and wherein each of the first parallel group and the second parallel group is uniformly distributed according to the corresponding first circumferential distribution or second circumferential distribution at a uniform radial distance from the common axis.

8. The valve assembly of claim 1 wherein the valve body further includes an outer housing piece, and an insert piece defining a central bore, and the insert piece forming an inlet annulus with the outer housing piece and having a plurality of inlet orifices formed therein and extending between the inlet annulus and the central bore, and wherein the valve stack is within the central bore such that the fluid inlet is in fluid communication with the plurality of inlet orifices.

9. The valve assembly of claim 8 wherein the valve stack includes an inlet piece having a plurality of incoming fluid passages extending radially inward from the fluid inlet, an outlet piece, and a pumping piece, and wherein the inlet chamber is defined in part by the inlet piece and in part by the pumping piece, the outlet chamber is defined in part by the inlet piece and in part by the outlet piece, and the pumping chamber is defined in part by the pumping piece and in part by the insert piece.

10. A valve stack for a liquid pump comprising:

an inlet piece having formed therein each of an inlet valve seat, a fluid inlet, and a plurality of incoming fluid passages extending between the fluid inlet and the inlet valve seat;

an outlet piece positioned upon a first side of the inlet piece, the outlet piece having formed therein an outlet valve seat, and a fluid outlet;

a pumping piece positioned upon a second side of the inlet piece, such that the inlet piece is sandwiched between the pumping piece and the outlet piece;

an inlet check valve positioned at least partially within the inlet piece and movable between a closed position blocking the inlet valve seat, and an open position;

an outlet check valve positioned at least partially within the outlet piece, and movable between a closed position blocking the outlet valve seat, and an open position;

the inlet piece, the outlet piece, and the pumping piece defining a common axis, and each of the inlet check valve and the outlet check valve being movable along the common axis between the corresponding closed position and open position;

the valve stack further forming an inlet chamber between the inlet piece and the pumping piece, an outlet chamber between the inlet piece and the outlet piece, a pumping chamber, and a plurality of flow channels; and the plurality of flow channels being arranged in a first parallel group extending through the pumping piece between the inlet chamber and the pumping chamber and having a first circumferential distribution about the common axis, and a second parallel group extending through the inlet piece between the inlet chamber and the outlet chamber and having a second circumferential distribution about the common axis.

11. The valve stack of claim 10 wherein a flow area formed by the first parallel group is less than a flow area formed by the inlet valve seat.

12. The valve stack of claim 10 wherein a total number of the flow channels in the first parallel group is equal to a total number of the flow channels in the second parallel group.

13. The valve stack of claim 12 wherein each of the plurality of flow channels is positioned at a uniform radial distance from the common axis, and wherein the flow channels in the first parallel group are in an alternating arrangement about the common axis with the flow channels in the second parallel group.

14. The valve stack of claim 10 wherein the inlet valve seat includes a flat seat, and the outlet valve seat includes a conical seat, and each of the inlet valve seat and the outlet valve seat is centered upon the common axis.

15. A liquid pump comprising:

a pump housing having each of a pump inlet and a pump outlet formed therein;

an inlet metering valve structured to vary a flow area of the pump inlet;

a valve assembly within the pump housing and including a valve body having a fluid inlet and a fluid outlet formed therein and a valve stack forming an inlet valve seat and an outlet valve seat;

an inlet check valve positioned at least partially within the valve stack and movable between a closed position blocking the inlet valve seat, and an open position;

an outlet check valve positioned at least partially within the valve stack and movable between a closed position blocking the outlet valve seat, and an open position;

a plunger movable within the valve body between a retracted position and an advanced position;

the inlet check valve, the outlet check valve, and the plunger defining a common axis that extends through the valve stack, and the inlet check valve being located axially between the outlet check valve and the plunger;

the valve body further having formed therein a pumping chamber receiving the plunger, an inlet chamber within the valve stack, and an outlet chamber within the valve stack, and each of the pumping chamber, the inlet chamber, and the outlet chamber being centered on the common axis; and a plurality of flow channels for transitioning a pumped liquid through the valve stack between the fluid inlet and the fluid outlet, and being arranged in a first parallel group extending between the inlet chamber and the pumping chamber and having a first circumferential distribution about the common axis, and a second parallel group extending between the inlet chamber and the outlet chamber and having a second circumferential distribution about the common axis;

wherein the valve body further includes an outer housing piece, and an insert piece defining a central bore, and the insert piece forming an inlet annulus with the outer housing piece and having a plurality of inlet orifices formed therein and extending between the inlet annulus and the central bore, and wherein the valve stack is within the central bore such that the fluid inlet is in fluid communication with the plurality of inlet orifices; and wherein the valve stack includes an inlet piece having a plurality of incoming fluid passages extending radially inward from the fluid inlet, an outlet piece, and a pumping piece, and wherein the inlet chamber is defined in part by the inlet piece and in part by the pumping piece, the outlet chamber is defined in part by the inlet piece and in part by the outlet piece, and the pumping chamber is defined in part by the pumping piece and in part by the insert piece.

16. The liquid pump of claim 15 wherein the valve assembly is a first valve assembly and further comprising a second valve assembly having a valve stack forming an inlet valve seat and an outlet valve seat, a plunger movable within the valve body of the second valve assembly, a first cam follower coupled with the plunger of the first valve assembly and a second cam follower coupled with the plunger of the second valve assembly.

17. The liquid pump of claim 16 wherein the pump housing has formed therein a common fluid pressure space, and each of the first valve assembly and the second valve assembly is positioned fluidly between the common fluid pressure space and the pump inlet.

18. The liquid pump of claim 15 wherein the plunger defines a swept volume, and the inlet chamber, the outlet chamber, the pumping chamber, and the plurality of flow channels define a combined volume that is from 2 times to 3 times the swept volume.

19. The liquid pump of claim 15 wherein a total number of flow channels in each of the first parallel group and the second parallel group is eight, and wherein each of the first parallel group and the second parallel group is uniformly distributed according to the corresponding first circumferential distribution or second circumferential distribution at a uniform radial distance from the common axis.

20. The liquid pump of claim 19 wherein a flow area formed by the first parallel group is less than a flow area formed by the inlet valve seat.

* * * * *